US006586868B1

(12) United States Patent
Takekawa et al.

(10) Patent No.: US 6,586,868 B1
(45) Date of Patent: Jul. 1, 2003

(54) COLOR CATHODE-RAY TUBE APPARATUS WITH MULTI-LENS ELECTRON FOCUSING AND YOKE DEFLECTION

(75) Inventors: Tsutomu Takekawa, Fukaya (JP); Hirofumi Ueno, Fukaya (JP); Kazunori Satou, Fukaya (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 206 days.

(21) Appl. No.: 09/596,050

(22) Filed: Jun. 16, 2000

(30) Foreign Application Priority Data

Jul. 12, 1999 (JP) ..... 11-197192
Mar. 16, 2000 (JP) ..... 2000-073854

(51) Int. Cl.[7] ..... H01J 29/50; H01J 29/46
(52) U.S. Cl. ..... 313/414; 313/446; 313/449
(58) Field of Search ..... 313/412, 414, 313/428, 437, 382, 444, 446, 448, 449

(56) References Cited

U.S. PATENT DOCUMENTS 5,608,284 A * 3/1997 Tojyou et al. ..... 313/412
6,335,597 B1 * 1/2002 Ueno et al. ..... 313/412
6,339,293 B1 * 1/2002 Kimiya et al. ..... 313/421

FOREIGN PATENT DOCUMENTS

JP 2685764 8/1997

* cited by examiner

*Primary Examiner*—Nimeshkumar D. Patel
*Assistant Examiner*—Matt Hodges
(74) *Attorney, Agent, or Firm*—Oblon, Spivak, McClelland, Maier & Neustadt, P.C.

(57) ABSTRACT

An electron gun structure applied to a color cathode-ray tube comprises a focus electrode, an ultimate acceleration electrode and at least one intermediate electrode disposed between the focus electrode and the ultimate acceleration electrode, the focus electrode, the ultimate acceleration electrode and the at least one intermediate electrode forming a main lens. The electron gun structure also comprises a voltage application unit for applying to the focus electrode a dynamic voltage increasing in accordance with an increase in a degree of deflection of the electron beams, and applying to the intermediate electrode a voltage obtained by dividing a voltage applied to the ultimate acceleration electrode by means of a voltage dividing resistor. The electron gun structure further comprises at least one cylindrical additional electrode electrically insulatively covering a part of the electrode constituting the electron lens, the at least one cylindrical additional electrode being electrically connected to the intermediate electrode.

8 Claims, 10 Drawing Sheets

COLOR CATHODE-RAY TUBE APPARATUS WITH MULTI-LENS ELECTRON FOCUSING AND YOKE DEFLECTION

CROSS-REFERENCE TO RELATED APPLICATIONS

This application is based upon and claims the benefit of priority from the prior Japanese Patent Applications No. 11-197192, filed Jul. 12, 1999; and No. 2000-073854, filed Mar. 16, 2000, the entire contents of which are incorporated herein by reference.

BACKGROUND OF THE INVENTION

The present invention relates to a color cathode-ray tube (CRT) apparatus, and more particularly to a color CRT apparatus capable of displaying a high-quality image, with reduction in oval deformation of a beam spot on a peripheral portion of a screen.

Self-convergence in-line type color CRT apparatuses, each having an electron gun structure with a BPF (Bi-Potential Focus) type DAC&F (Dynamic Astigmatism Correction and Focus) system, have now been widely used.

The electron gun structure with the BPF type DAC&F system, as shown in FIG. 16, comprises three cathodes K arranged in line; a first grid G1; a second grid G2; a third grid G3 having two segments G31 and G32; and a fourth grid G4. The grids G1 to G4 are disposed in the named order from the cathodes (K) side toward a phosphor screen. Each grid has three in-line electron beam passage holes which are formed in association with the three cathodes K.

A voltage obtained by superimposing video signals upon a voltage of about 150 V is applied to the cathodes K. The first grid G1 is grounded. A voltage of about 600 V is applied to the second grid G2. A DC voltage of about 6 kV is applied to the first segment G31 of the third grid G3. A dynamic voltage obtained by superimposing a parabolic AC voltage component, which increases in accordance with an increase in the degree of deflection of an electron beam, upon a DC voltage of about 6 kV, is applied to the second segment G32 of the third grid G3. A voltage of about 26 kV is applied to the fourth grid G4.

An electron beam generating unit is constituted by the cathodes K, first grid G1 and second grid G2. The electron beam generating unit generates electron beams and forms an object point for a main lens. A prefocus lens is constituted by the second grid G2 and the first segment G31 and it prefocuses the electron beams generated from the electron beam generating unit. A BPF type main lens is constituted by the second segment G32 and the fourth grid G4. The BPF type main lens accelerates the prefocused electron beams toward the phosphor screen and ultimately focuses them on the phosphor screen.

Where electron beams are deflected onto a corner portion of the phosphor screen, a potential difference between the second segment G32 and the fourth grid G4 takes a minimum value and the intensity of the main lens formed therebetween lowers to a minimum. At the same time, a maximum potential difference is provided between the first segment G31 and the second segment G32, and a quadrupole lens is formed which has a focusing function in a horizontal direction and a divergence function in a vertical direction. At this time, the intensity of the quadrupole lens takes a maximum value.

Where the electron beams are deflected onto a corner portion on the phosphor screen, a distance between the electron gun structure and the phosphor screen becomes longest and an image point is formed at a farther position. In the case of the electron gun structure with the above-described BPF type DAC&F system, the formation of the image point at a farther position is compensated by decreasing the intensity of the main lens. In addition, a deflection aberration caused by a pin-cushion-shaped horizontal deflection magnetic field and a barrel-shaped vertical deflection magnetic field of a deflection yoke is compensated by the formation of a quadrupole lens.

In order to enhance the image quality in the color CRT apparatus, it is necessary to improve the focusing characteristics and beam spot shape on the phosphor screen. In the conventional in-line type color CRT apparatus, as shown in FIG. 17, a beam spot 1 formed on a central area of the phosphor screen is circular but a beam spot 1 formed on a peripheral area extending from an end of a horizontal axis (X-axis) to an end of a diagonal axis (D-axis) is deformed in an oval shape along a horizontal axis (X-axis) ("horizontal deformation") due to deflection aberration and a blur 2 occurs along a vertical axis (Y-axis). The image quality is thus degraded.

In order to solve this problem, in the electron gun structure with the BPF type DAC&F system, the low-voltage-side grid constituting the main lens is composed of a plurality of segments, like the third grid G3, and a quadrupole lens which has a lens intensity varying dynamically in accordance with a deflection amount of the electron beam is formed between the segments. Accordingly, the blur 2 of the beam spot 1 is eliminated, as shown in FIG. 18.

However, in the electron gun structure with the BPF type DAC&F system, too, horizontal deformation occurs in the beam spot 1 formed on the peripheral area extending from the end of the horizontal axis (X-axis) to the end of the diagonal axis (D-axis), as shown in FIG. 18. The horizontal deformation of the beam spot 1 occurs because the electron gun structure is of the in-line type, the horizontal deflection magnetic field generated by the deflection yoke has a pin-cushion shape, and the vertical deflection magnetic field generated by the same has a barrel shape.

The horizontal deformation of the beam spot 1 will now be explained with reference to optical models shown in FIGS. 19A and 19B. In FIGS. 19A and 19B, an upper-side portion of a tube axis (Z-axis) corresponds to a cross-sectional view taken along a vertical axis (Y-axis), and a lower-side portion of the tube axis corresponds to a cross-sectional view taken along a horizontal axis (X-axis). FIG. 19A shows an optical model wherein an electron beam 4 is made incident on a central portion of a phosphor screen 5, without being deflected. FIG. 19B shows an optical model wherein the electron beam 4 is deflected and made incident on a peripheral portion of the phosphor screen 5. In these figures, ML denotes a main lens, QL denotes a quadrupole lens, and DL denotes a quadrupole lens component formed by deflection magnetic fields.

In general, the size of the beam spot 1 on the phosphor screen varies depending on a magnification M. The magnification M is expressed by a ratio of a divergence angle $\alpha 0$ of the electron beam 4 to an incidence angle $\alpha i$ on the phosphor screen:

$$\alpha 0/\alpha i$$

Where a horizontal divergence angle is $\alpha 0h1$, a horizontal incidence angle is $\alpha ih1$, a vertical divergence angle $\alpha 0v1$ and a vertical incidence angle $\alpha iv1$, a horizontal magnification Mh1 and a vertical magnification Mv1 are given by $$Mh1=\alpha 0h1/\alpha ih1$$

$$Mv1=\alpha 0v1/\alpha iv1$$

Accordingly, where 0h1=α0v1, the following equation is obtained at the time of non-deflection, as shown in FIG. 19A, by the main lens ML having uniform focusing functions mainly in the horizontal and vertical directions:

$$\alpha ih1=\alpha iv1$$

Therefore, Mh1=Mv1, and a circular beam spot is formed on a central portion of the phosphor screen.

On the other hand, at the time of deflection, as shown in FIG. 19B, in order to compensate the quadrupole lens component DL of the deflection fields having a diverging function in the horizontal direction and a focusing function in the vertical direction, the quadrupole lens QL having a focusing function in the horizontal direction and a diverging function in the vertical direction is formed in front of the main lens ML. Accordingly, $$\alpha ih1<\alpha iv1$$

and $$Mh1>Mv1$$

Thus, an oval beam spot is formed on a peripheral portion of the phosphor screen.

As has been described above, in order to enhance the image quality of the color CRT apparatus, the focusing characteristics and beam spot shape on the phosphor screen need to be improved.

With the conventional electron gun structure of the BPF type DAC&F system, a vertical blue of the beam spot due to deflection aberration is eliminated and the beams are focused over the entire area of the phosphor screen. However, in the case of the conventional electron gun structure of the BPF type DAC&F system, horizontal deformation of the beam spot formed on a peripheral area extending from an end of the horizontal axis to an end of the diagonal axis on the phosphor screen cannot be eliminated. Consequently, the horizontal deformation of the beam spot interferes with the electron beam passage holes in the shadow mask, thus causing moire, etc. and degrading the quality of display images such as characters.

BRIEF SUMMARY OF THE INVENTION

The present invention has been made in order to overcome the above problems, and the object of the invention is to provide a color cathode-ray tube capable of displaying a high-quality image, while reducing an oval deformation of a beam spot on a peripheral area of a screen.

According to the present invention, in order to achieve the above object, there is provided a color cathode-ray tube apparatus having an electron gun structure forming a plurality of electron lenses including a main lens for focusing electron beams on a phosphor screen, and a deflection yoke for horizontally and vertically deflecting the electron beams emitted from the electron gun structure, wherein the electron gun structure comprises:

a focus electrode, an ultimate acceleration electrode and at least one intermediate electrode disposed between the focus electrode and the ultimate acceleration electrode, the focus electrode, the ultimate acceleration electrode and the at least one intermediate electrode forming the main lens;

voltage application means for applying to the focus electrode a dynamic voltage increasing in accordance with an increase in a degree of deflection of the electron beams, and applying to the intermediate electrode a voltage obtained by dividing a voltage applied to the ultimate acceleration electrode by means of a voltage dividing resistor; and at least one additional electrode electrically insulatively covering a part of the electrode constituting the electron lens, the at least one additional electrode being electrically connected to the intermediate electrode.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Embodiments of the color cathode-ray tube (CRT) apparatus according to the present invention will now be described with reference to the accompanying drawings.

As has been described above, in the conventional electron gun structure with the BPF type DAC&F system, the quadrupole lens is formed in front of the main lens at the time of deflection when the electron beam is deflected onto the peripheral portion of the phosphor screen. Consequently, the horizontal magnification Mh1 and vertical magnification Mv1 of the beam spot focused on the peripheral portion of the phosphor screen have the relationship, $$Mh1>Mv1$$

and horizontal deformation of the beam spot occurs. In order to eliminate the horizontal deformation, it is necessary to increase αih and decrease αiv, thereby reducing a difference between Mh and Mv.

In the color CRT apparatus according to the present invention, a quadrupole lens is formed within a main lens at the time of deflection and the quadrupole lens is made to effectively function. Thereby, a difference between the horizontal magnification and vertical magnification is reduced.

Figure 1A:
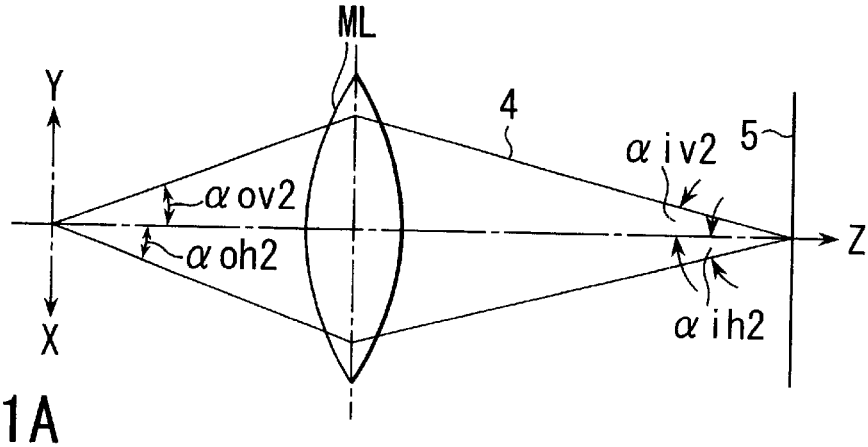
FIG. 1A and FIG. 1B show optical models for describing a basic constitution of an electron gun structure applied to a color CRT apparatus according to an embodiment of the present invention.
Figure 1B:
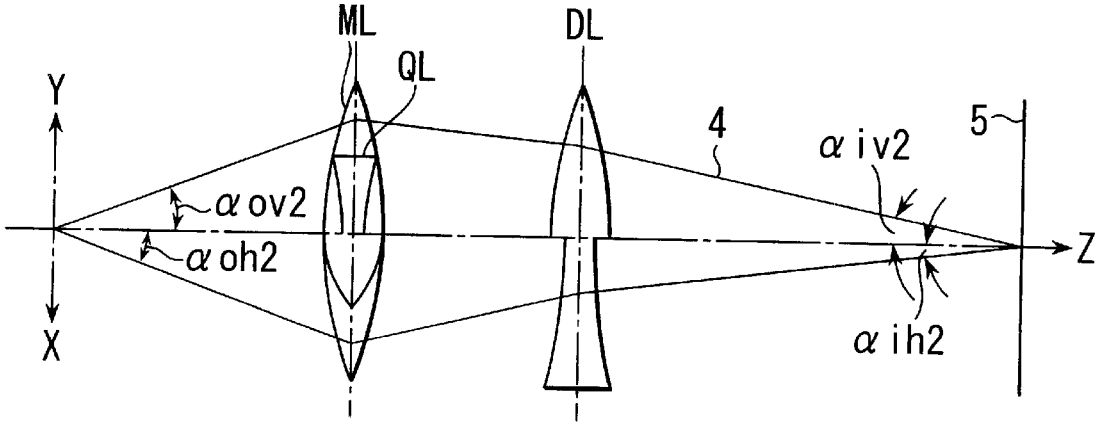

Specifically, in an optical model, as shown in FIG. 1B, wherein a quadrupole lens QL is formed within a main lens ML, a horizontal magnification Mh2 and a vertical magnification Mv2 are given by $$Mh2=\alpha 0h2/\alpha ih2$$

$$Mv2=\alpha 0v2/\alpha iv2$$

Figure 19A:
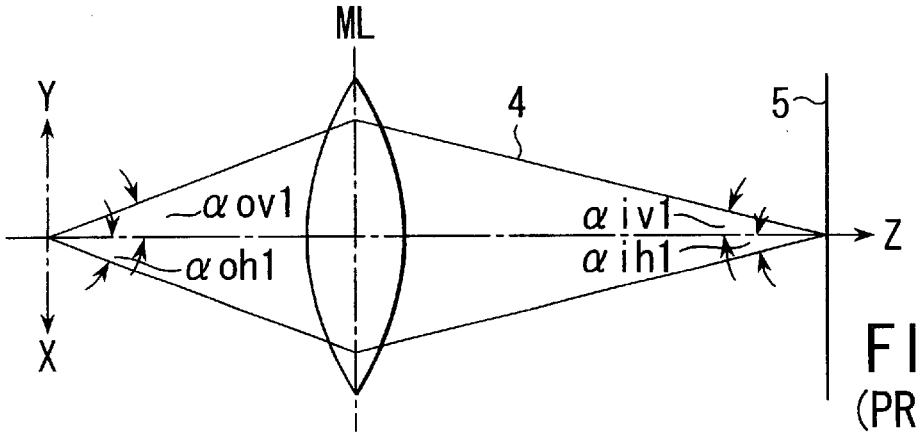
FIG. 19A (PRIOR ART)
FIG. 19A shows an optical model at a time of non-deflection of the electron gun structure with a BPF type DAC&F system, as shown in FIG. 16.
Figure 19B:
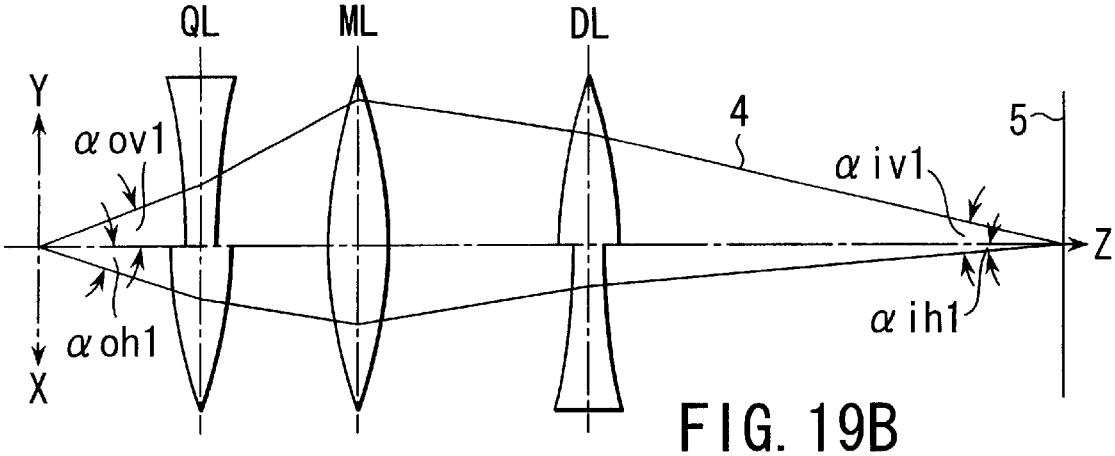
FIG. 19B (PRIOR ART)
FIG. 19B shows an optical model at a time of deflection of the electron gun structure with a BPF type DAC&F system, as shown in FIG. 16.

In addition, compared to the conventional electron gun structure as illustrated in FIGS. 19A and 19B, the quadrupole lens QL formed within the main lens ML becomes closer to the quadrupole lens component DL formed by the deflection fields. Accordingly, $$\alpha 0h1=\alpha 0h2$$

$$\alpha 0v1=\alpha 0v2$$

$$\alpha ih1<\alpha ih2$$

$$\alpha iv1>\alpha iv2,$$

and thus, $$Mh2<Mh1$$

$$Mv2>Mv1.$$

Figure 2:
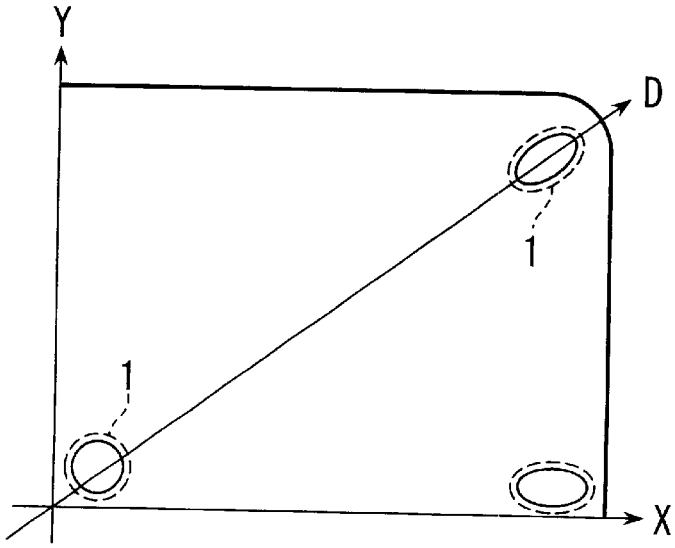
FIG. 2 is a view for explaining reduction of horizontal deformation of a beam spot on a phosphor screen of a color CRT apparatus according to an embodiment of the invention.

By increasing αih2 and decreasing αiv 2 in this way, the difference between Mh2 and Mv2 can be reduced and, as shown in FIG. 2, horizontal deformation of the beam spot 1 on the peripheral portion of the screen can be reduced.

The main lens in which the quadrupole lens is formed is obtained such that at least one intermediate electrode having a non-circular electron beam passage hole is disposed between a focus electrode and an ultimate acceleration electrode which form the main lens and a dynamic voltage increasing in accordance with an increase in the degree of deflection of the electron beam is applied to the focus electrode. Besides, in order to make the quadrupole lens within the main lens effectively function, at least one additional electrode is disposed. This additional electrode is disposed to electrically insulatively cover at least a part of the electrode constituting the main lens. The additional electrode is electrically connected to the intermediate electrode.

An example of the electron gun structure having the above structure will now be described. A plate-like intermediate electrode having a non-circular electron beam passage hole with a long axis set in a horizontal direction is disposed at a geometrical center between the focus electrode and ultimate acceleration electrode which form the main lens. An additional electrode is disposed on the focus electrode. At this time, for example, a dynamic voltage obtained by superimposing a parabolic AC voltage component, which rises in accordance with an increase in the degree of deflection of the electron beam, upon a DC voltage of about 6 kV is applied to the focus electrode. A high voltage of 26 kV is applied to the ultimate acceleration electrode. A voltage of 16 kV is applied to the intermediate electrode.

With this electron gun structure, at the time of non-deflection when the electron beam is focused on the central portion of the phosphor screen, the focus electrode-side electric field intensity of the intermediate electrode is equal to the ultimate acceleration electrode-side electric field intensity of the intermediate electrode. Thus, the potential forming the main lens does not permeate into the electron beam passage hole of the intermediate electrode. As a result, the main lens formed by the focus electrode, intermediate electrode and ultimate acceleration electrode becomes equivalent to the BPF type lens, as shown in FIG. 1A, which is formed by the focus electrode and ultimate acceleration electrode without the intermediate electrode. Accordingly, the focusing power becomes equal in the horizontal direction (X-axis) and the vertical direction (Y-axis).

At the time of deflection when the electron beam is deflected onto the peripheral portion of the phosphor screen, an AC voltage corresponding to the AC voltage component (parabolic voltage) of the dynamic voltage applied to the focus electrode is induced in the intermediate electrode by a capacitance between the intermediate electrode and the focus electrode and a capacitance between the focus electrode and the additional electrode disposed on the focus electrode. As a result, the potential of the intermediate electrode rises. If the potential of the intermediate electrode rises, the main lens has a potential distribution different from that of the bi-potential type main lens. Specifically, the focus electrode-side electric field intensity of the intermediate electrode is higher than the ultimate acceleration electrode-side electric field intensity of the intermediate electrode. Consequently, the focus electrode-side potential permeates to the ultimate acceleration electrode side via the non-circular electron beam passage hole with a horizontal long axis in the intermediate electrode. The quadrupole lens having the horizontal focusing function and vertical diverging function is thus formed within the main lens, and astigmatism occurs in the main lens. Therefore, as shown in FIG. 1B, the difference between the horizontal magnification Mh2 and vertical magnification Mv2 is reduced, the horizontal deformation of the beam spot on the peripheral portion of the phosphor screen is reduced, and the blur of the beam spot is eliminated.

Figure 3A:
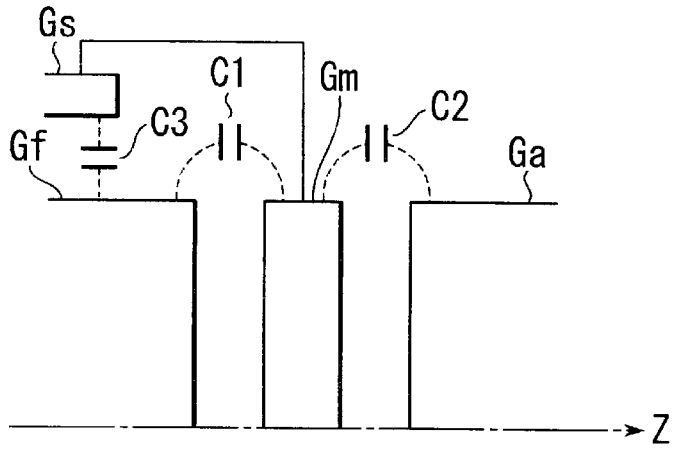
FIG. 3A and FIG. 3B are views for explaining a capacitance occurring between an intermediate electrode and another electrode in an electron gun structure applied to a color CRT apparatus according to an embodiment of the invention.

In this case, in order to obtain an adequate intensity of the quadrupole lens, it is necessary to increase the AC voltage induced in the intermediate electrode. Where a capacitance between the intermediate electrode Gm and focus electrode Gf is C1, a capacitance between the intermediate electrode Gm and ultimate acceleration electrode Ga is C2, a capacitance between the additional electrode Gs and focus electrode Gf is C3 and an AC voltage component of the dynamic voltage applied to the focus electrode Gf is Vd, as shown in FIG. 3A, the AC voltage V1 induced in the intermediate electrode is given by $$V1 = \frac{C1 + C3}{C1 + C2 + C3} Vd \tag{1}$$

Where the intermediate electrode Gm is disposed at a geometrical center between the focus electrode Gf and ultimate acceleration electrode Ga, that is, at an equidistant position from the focus electrode Gf and ultimate acceleration electrode Ga, $$C1 = C2$$

Thus, equation 1 is developed to $$V1 = \frac{C1 + C3}{2C1 + C3} Vd \tag{2}$$

Accordingly, when an adequate intensity of the quadrupole lens is to be obtained, the capacitance C3 between the intermediate electrode Gm and focus electrode Gf is increased and thus the difference between the focus electrode (Gf)-side electric field intensity of the intermediate electrode Gm and the ultimate acceleration electrode (Ga)-side electric field intensity of the intermediate electrode Gm is increased. Thereby, the focus electrode-side potential greatly permeates to the ultimate acceleration electrode side via the non-circular electron beam passage hole in the intermediate electrode. Thus, the lens intensity of the quadrupole lens can be increased. This suggests that if the capacitance C3 between the additional electrode Gs and focus electrode Gf is increased, the quadrupole lens with a desired lens intensity is obtained and, moreover, the dynamic voltage including a necessary AC voltage component can be lowered.

The space within the neck, in which the electron gun structure is disposed, is narrow, and it is difficult to dispose therein a capacitor having a sufficient capacitance. However, if the additional electrode Gs is disposed on at least a part of the focus electrode Gf, as in the above-described electron gun structure, a capacitor having a capacitance of several-ten pF can easily be created and the intensity of the quadrupole lens can efficiently be increased.

For example, if $$C1 = C2 = 2.5pF$$

$$C3 = 48.5pF,$$

the AC voltage V1 is given, from equation 2, as follows:

$$\begin{aligned} V1 &= [(2.5 + 48.5)/(2 \times 2.5 + 48.5)]Vd \\ &= 0.95\ Vd. \end{aligned}$$

Thus, the AC voltage V1 corresponding to about 95% of the AC voltage component Vd can be induced in the intermediate electrode Gm, and the intensity of the quadrupole lens can be sufficiently increased.

Furthermore, since a variance in the capacitance C3 directly affects the focusing performance, such a variance needs to be reduced as much as possible. As regards this matter, if the additional electrode is disposed on the electrode forming the main lens, as described above, even if the additional electrode is eccentrically disposed on the electrode forming the main lens, a wide gap portion and a narrow gap portion are equally created between both electrodes. Accordingly, a variation in capacitance is canceled. Thus, a variance in the capacitance C3 is reduced and a stable focusing performance is obtained.

With the above structure, there is provided a color CRT apparatus which has a stable focusing performance while effectively reducing horizontal deformation of the beam spot and eliminating a blur of the spot.

Another example of the electron gun structure will now be described.

Figure 3B:
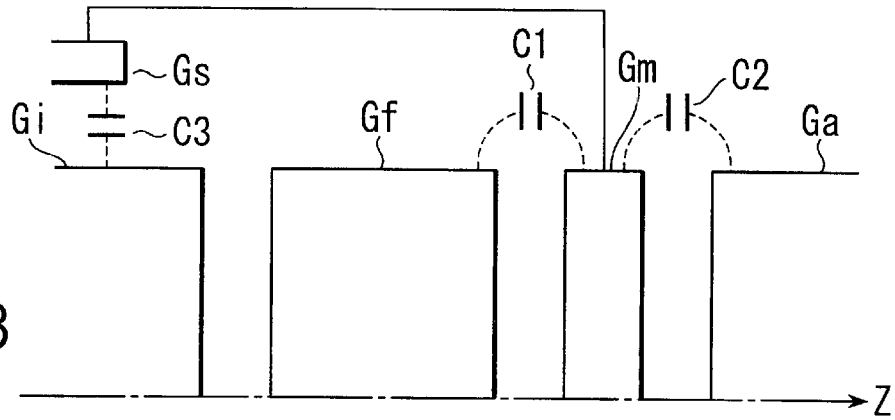

As is shown in FIG. 3B, a plate-like intermediate electrode Gm having a non-circular electron beam passage hole with a vertical long axis is disposed at a geometrical center between a focus electrode Gf forming a main lens and an ultimate acceleration electrode Ga. An additional electrode Gs is disposed on an electrode Gi different from the focus electrode Gf. No dynamic voltage is applied to the electrode Gi. The additional electrode Gs is electrically connected to the intermediate electrode Gm. With the electron gun structure having this constitution, too, the same operational advantage as with the electron gun structure shown in FIG. 3A can be obtained. The electron gun structure shown in FIG. 3B, however, differs from that shown in FIG. 3A in that the AC voltage induced in the intermediate electrode Gm is reduced as much as possible.

Where a capacitance between the additional electrode Gs and electrode Gi is C3, an AC voltage V2 induced in the intermediate electrode Gm is expressed by $$V2 = \frac{C1}{C1 + C2 + C3} Vd \tag{3}$$

In this case, too, $$C1 = C2$$

Thus, equation 3 is developed to $$V2 = \frac{C1}{2C1 + C3} Vd \quad (4)$$

Accordingly, if the capacitance C3 between the additional electrode Gs and electrode Gi is made sufficiently greater than the capacitance C1 between the intermediate electrode Gm and focus electrode Gf, the AC voltage V2 induced in the intermediate electrode Gm can be decreased. Even if the dynamic voltage applied to the focus electrode Gf varies, the AC voltage V2 induced in the intermediate electrode Gm can be reduced. For example, if $$C1=C2=2.5pF$$

$$C3=48.5pF$$

the AC voltage V2 is given, from equation 4, as follows:

$$V2 = [(2.5)/(2\times 2.5 + 48.5)]Vd$$
$$= 0.05\ Vd.$$

Thus, the AC voltage V2 induced in the intermediate electrode Gm can be reduced to about 5% of the AC voltage component Vd, and the potential difference between the focus electrode Gf to which the dynamic voltage is applied and the intermediate electrode Gm can be decreased. Thereby, the difference between the focus electrode (Gf)-side electric field intensity of the intermediate electrode Gm and the ultimate acceleration electrode (Ga)-side electric field intensity of the intermediate electrode Gm is increased, and the intensity of the quadrupole lens can be increased. Therefore, the same operational advantage as with the preceding example can be obtained.

Embodiments of the color CRT apparatus having the above-described structure will now be described.

[Embodiment 1]

Figure 4:
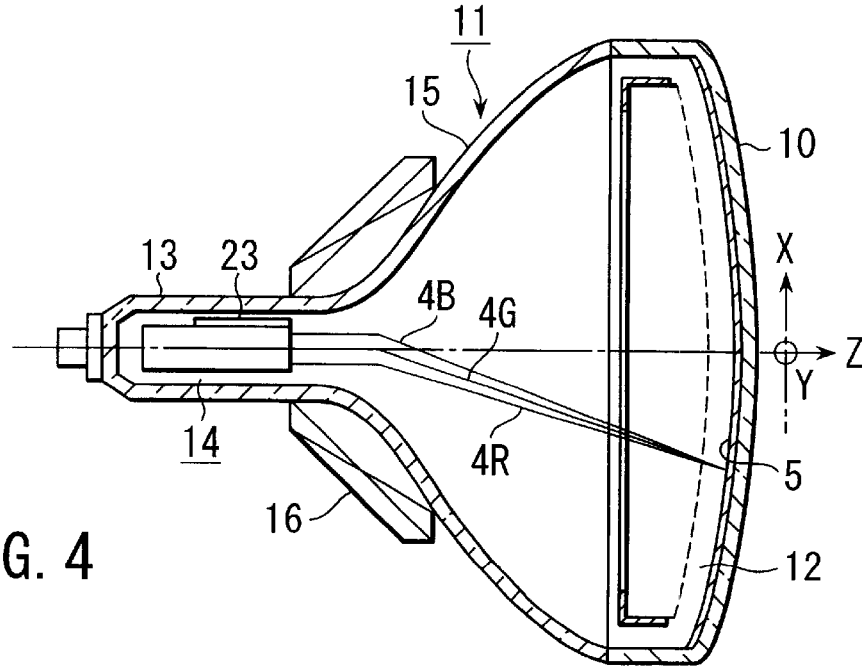
FIG. 4 shows the structure of a color CRT apparatus according to an embodiment of the invention.

As is shown in FIG. 4, an in-line type color CRT apparatus has an envelope comprising a panel 10, a neck 13 and a funnel 11. The panel 10 has, on its inner surface, a phosphor screen 5 composed of a three-color phosphor layer which emits blue, green and red. A shadow mask 12, which has a great number of electron beam passage holes on its inside, is disposed to be opposed to the phosphor screen 5. The neck 13 includes an in-line type electron gun structure 14. The electron gun structure 14 emits three in-line electron beams 4B, 4G and 4R, that is, a center beam 4G and a pair of side beams 4B and 4R, which travel in the same horizontal plane. A deflection yoke 16 is mounted on a region extending from a large-diameter portion 15 of the funnel 11 to the neck 13. The deflection yoke 16 generates non-uniform deflection magnetic fields for deflecting the three electron beams 4B, 4G and 4R emitted from the electron gun structure 14 in a horizontal direction (X) and a vertical direction (Y). The non-uniform deflection magnetic fields comprise a pin-cushion-shaped horizontal deflection magnetic field and a barrel-shaped vertical deflection magnetic field.

The three electron beams 4B, 4G and 4R emitted from the electron gun structure 14 are deflected by the non-uniform deflection fields generated by the deflection yoke 16 and horizontally and vertically scanned over the phosphor screen 5 via the shadow mask 12. Thereby, color images are displayed.

Figure 5:
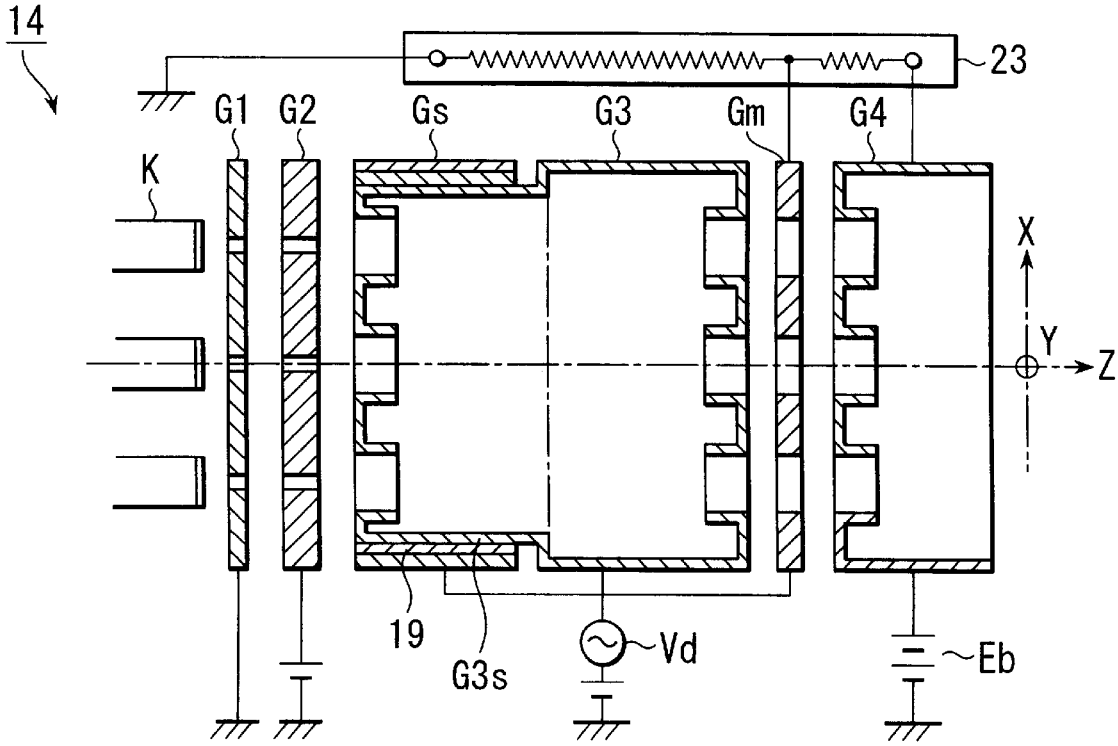
FIG. 5 shows a structure of an electron gun structure applied to a color CRT apparatus according to Embodiment 1 of the present invention.

As is shown in FIG. 5, the electron gun structure 14 comprises three cathodes K arranged in line in the horizontal direction (X); three heaters (not shown) for individually heating the cathodes K; and four electrodes. The four electrodes are a first grid G1; a second grid G2; a third grid G3; and a fourth grid G4. The four electrodes G1, G2, G3 and G4 are disposed in the named order from the cathodes (K) side toward the phosphor screen. The heaters, cathodes K and four electrodes are integrally fixed by a pair of insulating support members (not shown).

The first and second grids G1 and G2 are composed of integral plate-like electrodes, respectively. These plate-like electrodes have three in-line circular electron beam passage holes formed in the horizontal direction in association with the three cathodes K. The third grid G3 is composed of an integral cylindrical electrode. This cylindrical electrode has, in its both end faces, three in-line circular electron beam passage holes formed in the horizontal direction in association with the three cathodes K. The fourth grid G4 is composed of an integral cup-shaped electrode. The cup-shaped electrode has, in its end face opposed to the third grid G3, three in-line circular electron beam passage holes formed in the horizontal direction in association with the three cathodes K.

Figure 6A:
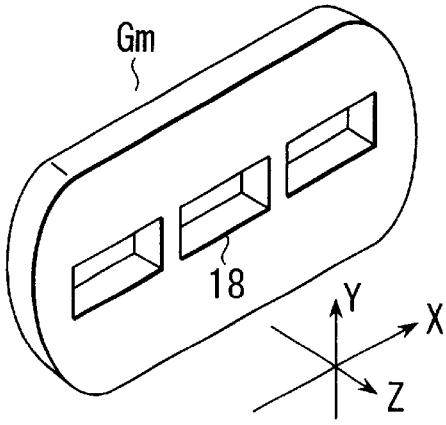
FIG. 6A and FIG. 6B show structures of an intermediate electrode applied to the electron gun structure shown in FIG. 5.
Figure 6B:
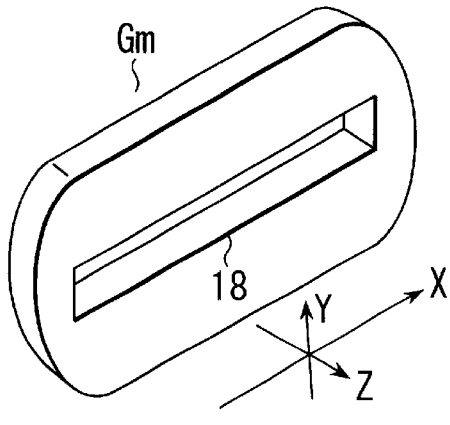

In addition, the electron gun structure 14 has a plate-like intermediate electrode Gm disposed at a geometrical center between the third grid G3 and fourth grid G4. The intermediate electrode Gm, as shown in FIG. 6A, has three in-line non-circular electron beam passage holes 18 each having a long axis in the horizontal direction (X). The beam passage holes 18 are arranged in the horizontal direction (X) in association with the three cathodes K. Alternatively, as shown in FIG. 6B, the intermediate electrode Gm may have a single non-circular electron beam passage hole 18 having a long axis in the horizontal direction (X). The intermediate electrode Gm as well as the other electrodes is fixed by the paired insulating support members.

The third grid G3 has a cylindrical small-diameter portion G3S on the second grid (G2) side. The diameter of the small-diameter portion G3S is less than that of the fourth grid G4. A cylindrical additional electrode Gs is disposed on an outer side of the small-diameter portion G3S, with a dielectric member 19 of, e.g. a ceramic material interposed. The additional electrode Gs is electrically connected to the intermediate electrode Gm in the state in which the additional electrode Gs is electrically insulated from the small-diameter portion G3S by the dielectric member 19.

Figure 8:
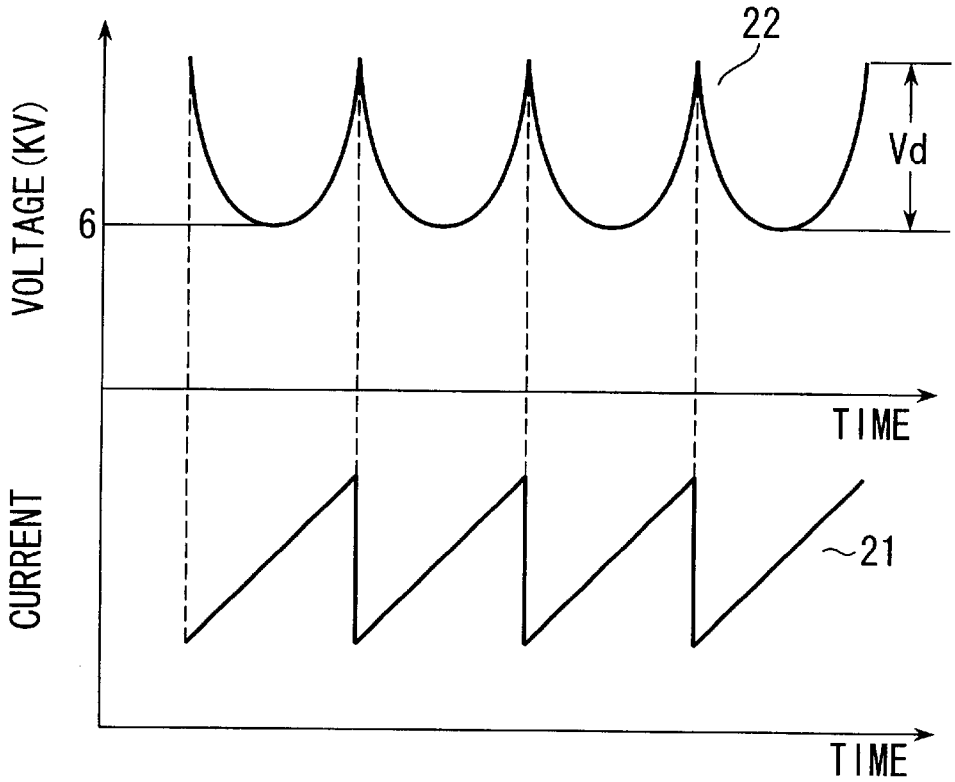
FIG. 8 shows a relationship between a deflection current supplied to a deflection yoke and a dynamic voltage applied to a third grid of the electron gun structure in synchronism with the deflection current.

In the electron gun structure 14 having the above structure, a voltage obtained by superimposing video signals upon a DC voltage of 150 V is applied to the cathodes K. The first grid G1 is grounded. A DC voltage of about 600 V is applied to the second grid G2. A dynamic voltage 22, which is obtained by superimposing a parabolically variable AC voltage component Vd upon a DC voltage of about 6 kV, as shown in FIG. 8, is applied to the third grid G3. The AC voltage component Vd is synchronized with a sawtooth deflection current 21 and increases in a parabolic fashion in accordance with an increase in the degree of deflection of the electron beam. An anode voltage Eb of about 26 kV is applied to the fourth grid G4. A voltage of about 16 kV is applied to the intermediate electrode Gm and additional electrode Gs. The voltage to be applied to the intermediate electrode Gm and additional electrode Gs is obtained by dividing the anode voltage Eb applied to the fourth grid G4 by means of a voltage-dividing resistor 23 disposed along the electron gun structure 14, as shown in FIG. 5.

With the application of the voltages to the respective grids, the electron gun structure 14 forms an electron beam generating unit, a prefocus lens and a main lens. The electron beam generating unit is constituted by the cathodes K, first grid G1 and second grid G2. The electron beam generating unit generates electron beams and forms an object point for a main lens. The prefocus lens is constituted by the second grid G2 and the third grid G3 and it prefocuses the electron beams generated from the electron beam generating unit. The main lens is constituted by the third grid G3 (focus electrode) and the fourth grid G4 (ultimate acceleration electrode). The main lens ultimately focuses the electron beams on the phosphor screen. At the time of deflection, a quadrupole lens is formed within the main lens by the intermediate electrode Gm disposed between the third grid G3 and fourth grid G4.

As has already been described with reference to FIG. 3A, in the electron gun structure 14 having the above structure, if the dynamic voltage 22 including the AC voltage component Vd is applied to the third grid G3, the AC voltage V1 expressed by equation 2 is induced in the intermediate electrode Gm by the capacitance C1 between the intermediate electrode Gm and third grid G3 and the capacitance C2 between the third grid G3 and additional electrode Gs.

Figure 7A:
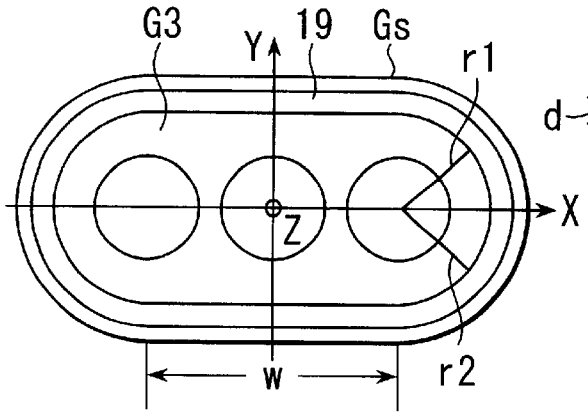
FIG. 7A and FIG. 7B are a top view and a partially cross-sectional plan view showing arrangement of an additional electrode in the electron gun structure shown in FIG. 5, respectively.
Figure 7B:
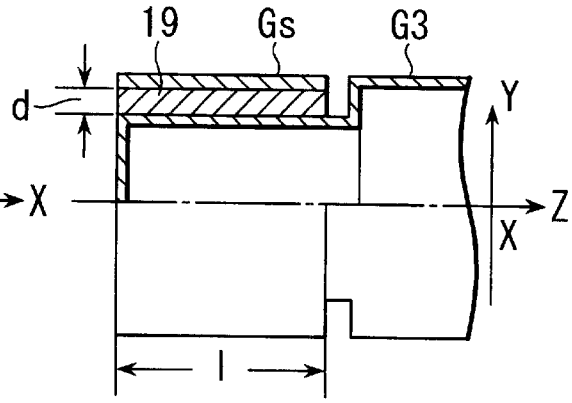

Assume, as shown in FIG. 7A and FIG. 7B, that an outside diameter of a semi-cylindrical portion of the third grid G3 at an end thereof along the horizontal axis (X-axis) is r1, an inside diameter of a semi-cylindrical portion of the additional electrode Gs at an end thereof along the horizontal axis (X-axis) is r2, a length of a flat portion of the third grid G3 at an end thereof along the vertical axis (Y-axis) is w, a length of a flat portion of the additional electrode Gs at an end thereof along the vertical axis (Y-axis) is 1, a distance between the third grid G3 and additional electrode Gs is d, a dielectric constant in a vacuum is $\epsilon 0$, and a specific dielectric constant of the dielectric member 19 is $\epsilon s$. In this case, the capacitance C3 is given by C3=(capacitance of semi-cylindrical portion)+(capacitance of flat portion), and expressed by $$C3 = \frac{2\pi\varepsilon_0\varepsilon_s}{\ln\frac{r2}{r1}} \times l + 2\pi\varepsilon_0\varepsilon_s\frac{w \times l}{d}\ (F) \tag{5}$$

Accordingly, if r1=4 mm r2=5 mm w=12 mm d=1 mm

1=15 mm $\epsilon s$=7, equation 6 is obtained:

$$C3 = \left(\frac{2 \times 3.14 \times 8.854 \times 10^{-12} \times 7}{\ln 5 \times \frac{10^{-3}}{4 \times 10^{-3}}} \times 15 \times 10^{-3}\right) + \left(2 \times 8.854 \times 10^{-12} \times 7\frac{12 \times 10^{-3} \times 15 \times 10^{-3}}{1 \times 10^{-3}}\right) = 48.5\ (\text{pF}) \tag{6}$$

Figure 9:
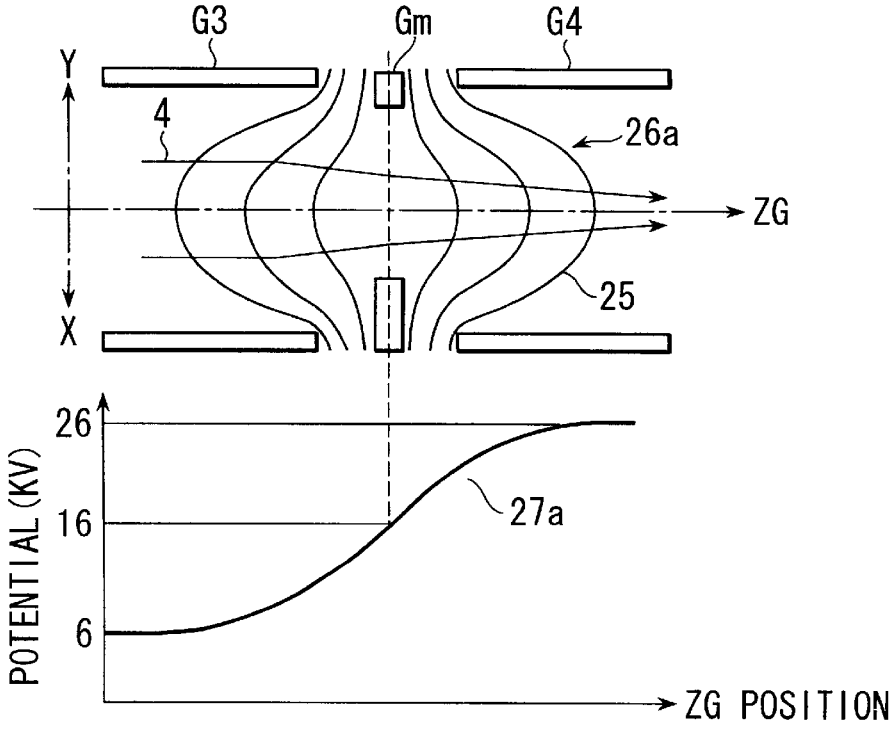
FIG. 9 is a view showing an electric field of a main lens at a time of non-deflection, in which an intermediate electrode is disposed, and a view showing a potential distribution on a center axis of an electron beam passage hole.
Figure 10:
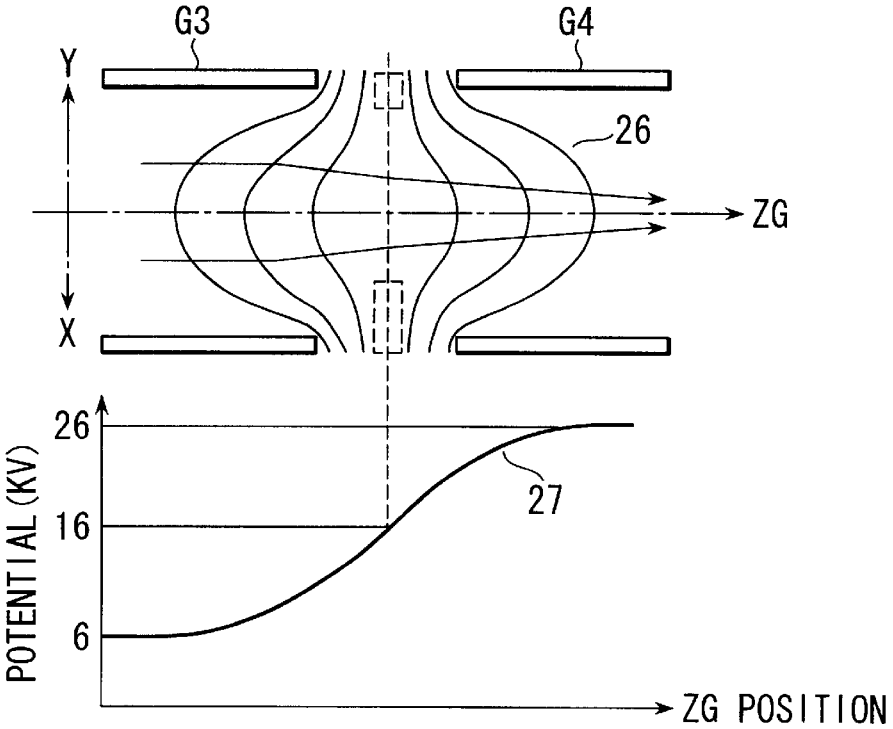
FIG. 10 is a view showing an electric field of a BPF type main lens, and a view showing a potential distribution on a center axis of an electron beam passage hole.

The intermediate electrode Gm is disposed at the geometrical center between the third grid G3 and fourth grid G4. At the time of non-deflection, an intermediate voltage (16 KV) between a voltage (6 KV) applied to the third grid G3 and a voltage (26 KV) applied to the fourth grid G4 is applied to the intermediate electrode Gm. Thus, an electric field 26*a* equivalent to an electric field 26 of the BPF type main lens is formed at the main lens, as shown in FIGS. 9 and 10. Specifically, FIGS. 9 and 10 show a vertical cross section of the main lens on an upper portion of a center axis ZG of the electron beam passage hole, a horizontal cross section of the main lens on a lower portion of the center axis ZG, and a potential distribution on the center axis ZG of the electron beam passage hole.

As is shown in FIG. 9, at the time of non-deflection, the main lens is formed by the electric field 26*a* indicated by an equipotential line 25. This main lens has equal focusing functions in the horizontal and vertical directions. The electric field 26*a* forming the main lens is equivalent to the electric field 26 of the BPF type main lens in which the intermediate electrode Gm is not disposed, as shown in FIG. 10. In addition, a potential distribution 27*a* on the center axis ZG of the electron beam passage hole is equal to a potential distribution 27 on the center axis ZG in the case where the intermediate electrode Gm is not disposed, as shown in FIG. 10. Accordingly, at the time of non-deflection, the quadrupole lens is not formed at the main lens, and the horizontal focusing power is equal to the vertical focusing power. No astigmatism occurs, and a substantially circular beam spot is formed on the central portion of the screen.

At the time of non-deflection, like the optical model shown in FIG. 1A, the electric field of the main lens ML is equivalent to the electric field of the BPF type main lens. Thus, if the horizontal emission angle $\alpha oh2$ is equal to the vertical emission angle $\alpha ov2$, the horizontal incidence angle $\alpha ih2$ on the phosphor screen 5 is equal to the vertical incidence angle $\alpha iv2$. Accordingly, the horizontal magnification Mh2 is equal to the vertical magnification Mv2. As a result, the electron beams emitted from the cathodes are pre-focused by the pre-focus lens and focused on the central portion of the screen by the main lens. A circular beam spot is thus formed.

Figure 11:
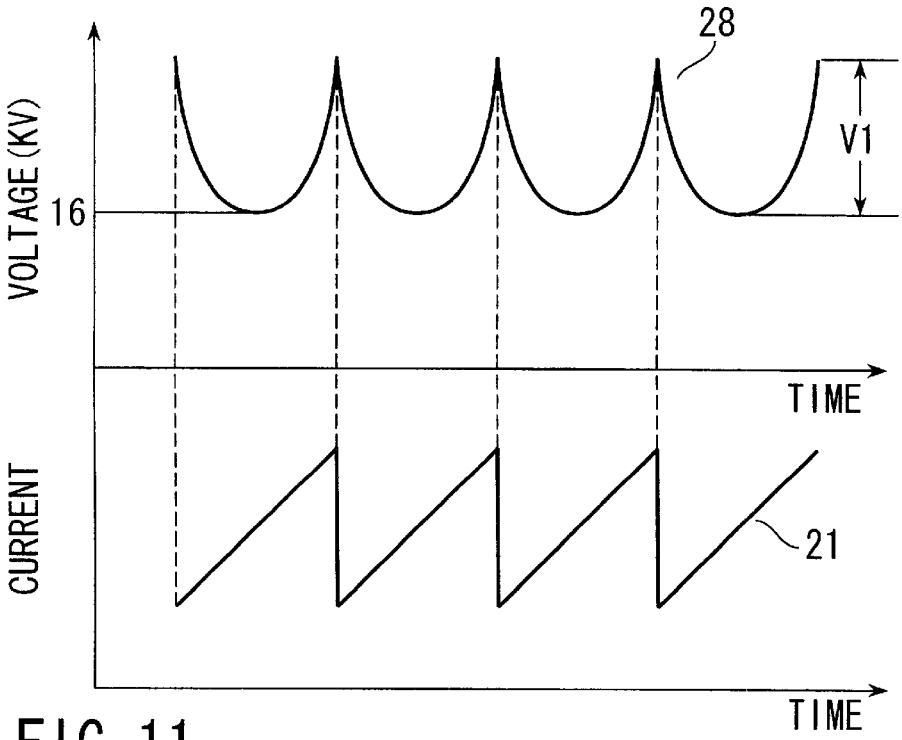
FIG. 11 shows a relationship between a deflection current supplied to the deflection yoke and an AC voltage induced in the intermediate electrode in synchronism with the deflection current.

At the time of deflection when the electron beam is deflected, the dynamic voltage applied to the third grid G3 rises in accordance with an increase in the degree of deflection of the electron beam. Consequently, the AC voltage V1 is induced in the intermediate electrode Gm by the AC voltage component Vd of the dynamic voltage through the capacitance C1 between the intermediate electrode Gm and third grid G3, capacitance C2 between the intermediate electrode Gm and fourth grid G4, and capacitance C3 between the additional electrode Gs and third grid G3. Specifically, the DC voltage of 16 KV applied to the intermediate electrode Gm becomes a voltage 28 in which the AC voltage V1 is induced, as shown in FIG. 11. The voltage 28 varies in a parabolic fashion in synchronism with a sawtooth deflection current 21. For example, as stated above, if $$C1=2.5pF$$

$$C1=2.5pF$$

$$C3=48.5pF$$

the AC voltage V1 induced in the intermediate electrode gm is $$V1=0.95Vd$$

If Vd=600 V, V1=570V.

Figure 12:
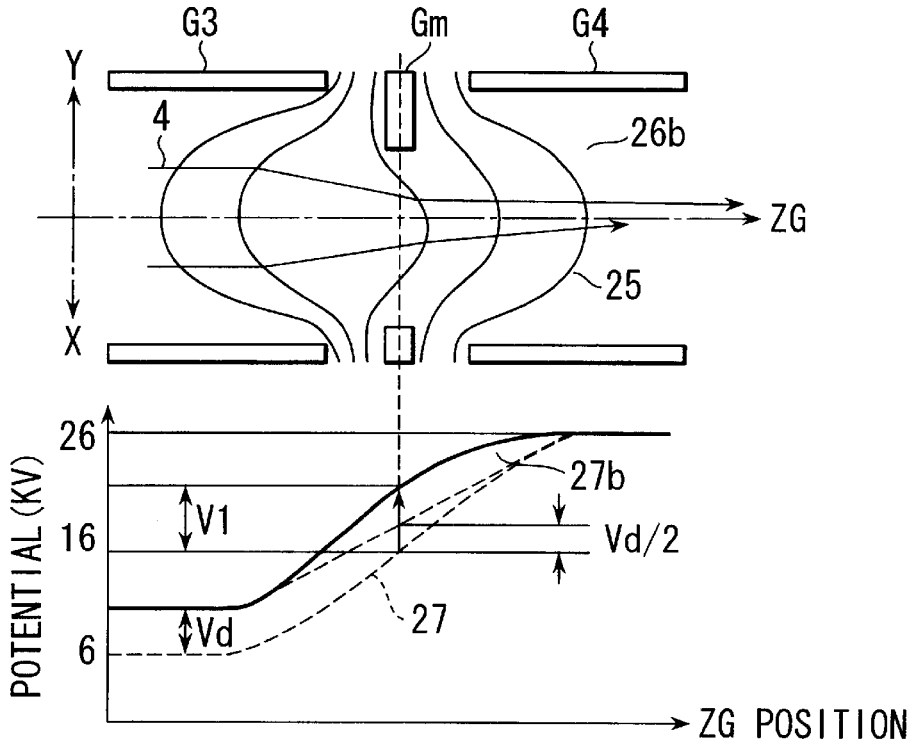
FIG. 12 is a view showing an electric field of the main lens at a time of deflection, and a view showing a potential distribution on the center axis of the electron beam passage hole.

In this case, the main lens is formed by an electric field 26*b* as shown in FIG. 12. This main lens produces a potential distribution 27*b* on the center axis ZG of the electron beam passage hole, as shown in FIG. 12. Specifically, with the rise in potential of the intermediate electrode Gm, the third grid (G3)-side electric field intensity of the intermediate electrode Gm becomes greater than the fourth grid (G4)-side electric field intensity of the intermediate electrode Gm. Consequently, the third grid (G3)-side potential permeates to the fourth grid (G4) side via the non-circular electron beam passage hole with a horizontal long axis in the intermediate electrode. Accordingly, the quadrupole lens having the horizontal focusing function and vertical diverging function is formed within the main lens. Thus, the main lens has astigmatism. As a result, the blur of the beam spot on the peripheral portion of the phosphor screen is eliminated. Moreover, the difference between the horizontal magnification Mh2 and vertical magnification Mv2 is reduced, and the horizontal deformation of the beam spot 1 on the peripheral portion of the screen is reduced, as shown in FIG. 2.

In the present case, since the additional electrode Gs is disposed on the side surface of the third grid G3 with the dielectric member 19 interposed, a variance in capacitance due to an axial displacement from the third grid G3 is reduced and the stable focusing performance is achieved.

[Embodiment 2]

Since the structure of the whole color CRT apparatus according to Embodiment 2 is the same as that according to Embodiment 1 shown in FIG. 4, except for the electron gun structure, a detailed description thereof is omitted.

Figure 13:
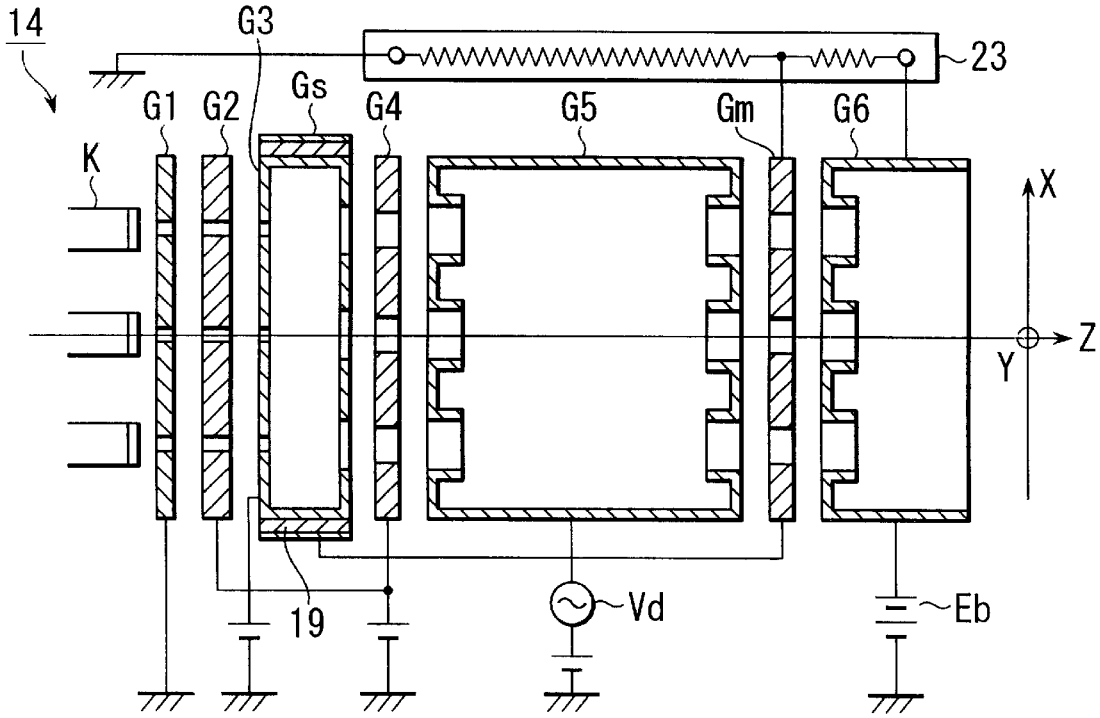
FIG. 13 shows a structure of an electron gun structure applied to a color CRT apparatus according to Embodiment 2 of the present invention.

As is shown in FIG. 13, the electron gun structure 14 comprises three cathodes K, three heaters (not shown) and six electrodes. The six electrodes are a first grid G1, a second grid G2, a third grid G3, a fourth grid G4, a fifth grid G5 (focus electrode), and a sixth electrode G6 (ultimate acceleration electrode). The six electrodes are disposed in the named order from the cathodes (K) side toward the phosphor screen. The heaters, cathodes K and six electrodes are integrally fixed by a pair of insulating support members (not shown).

The first and second grids G1 and G2 are composed of integral plate-like electrodes, respectively. These plate-like electrodes have three in-line circular electron beam passage holes formed in the horizontal direction in association with the three cathodes K. The third grid G3 is composed of an integral cylindrical electrode. This cylindrical electrode has, in its both end faces, three in-line circular electron beam passage holes formed in the horizontal direction in association with the three cathodes K. The fourth grid G4 is composed of an integral plate-like electrode. This plate-like electrode has three in-line circular electron beam passage holes formed in the horizontal direction in association with the three cathodes K. The fifth grid G5 is composed of an integral cylindrical electrode. This cylindrical electrode has, in its both end faces, three in-line circular electron beam passage holes formed in the horizontal direction in association with the three cathodes K. The sixth electrode G6 is composed of an integral cup-shaped electrode. The cup-shaped electrode has, in its end face opposed to the fifth grid G5, three in-line circular electron beam passage holes formed in the horizontal direction in association with the three cathodes K.

Figure 14:
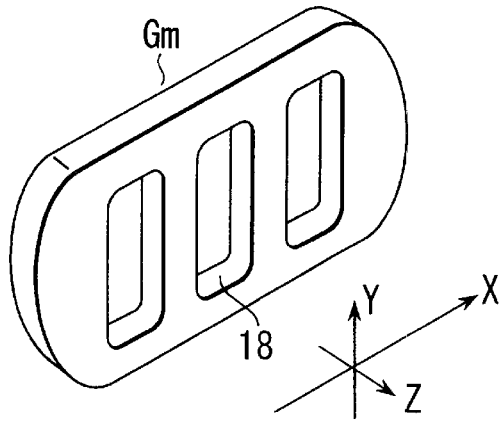
FIG. 14 shows a structure of an intermediate electrode applied to the electron gun structure shown in FIG. 13.

In addition, the electron gun structure 14 has a plate-like intermediate electrode Gm disposed at a geometrical center between the fifth grid G5 and sixth grid G6. The intermediate electrode Gm, as shown in FIG. 14, has three in-line non-circular electron beam passage holes 18 each having a long axis in the vertical direction. The beam passage holes 18 are arranged in the horizontal direction in association with the three cathodes K. The intermediate electrode Gm as well as the other electrodes is fixed by the paired insulating support members. A cylindrical additional electrode Gs is disposed on an outer side of the third grid G3, with a dielectric member 19 of, e.g. a ceramic material interposed. The additional electrode Gs is electrically connected to the intermediate electrode Gm in the state in which the additional electrode Gs is electrically insulated from the third grid G3 by the dielectric member 19.

In the electron gun structure 14 having the above structure, a voltage obtained by superimposing video signals upon a DC voltage of 150 V is applied to the cathodes K. The first grid G1 is grounded. A DC voltage of about 600 V is applied to the second grid G2. A DC voltage of about 6 kV is applied to the third grid G3. The fourth grid G4 is connected to the second grid G2 within the tube, and a DC voltage of about 600 V is applied to the fourth grid G4. A dynamic voltage 22, which is obtained by superimposing a parabolically variable AC voltage component Vd upon a DC voltage of about 6 kV, as shown in FIG. 8, is applied to the fifth grid G5. The AC voltage component Vd is synchronized with a sawtooth deflection current 21 and increases in a parabolic fashion in accordance with an increase in the degree of deflection of the electron beam. An anode voltage Eb of about 26 kV is applied to the sixth grid G6. A voltage of about 16 kV is applied to the intermediate electrode Gm and additional electrode Gs. The voltage to be applied to the intermediate electrode Gm and additional electrode Gs is obtained by dividing the anode voltage applied to the sixth grid G6 by means of a voltage-dividing resistor 23 disposed along the electron gun structure 14, as shown in FIG. 13.

At the time of non-deflection, like Embodiment 1, the main lens formed by the fifth grid G5, intermediate electrode Gm and sixth grid G6 is produced by an electric field equivalent to the electric field of the BPF type main lens formed by the fifth grid G5 and sixth grid G6. Accordingly, no quadrupole lens is formed in the main lens, and the horizontal focusing power is equal to the vertical focusing power. No astigmatism occurs, and a substantially circular beam spot is formed on the central portion of the screen.

At the time of deflection, the dynamic voltage applied to the fifth grid G5 rises in accordance with an increase in the degree of deflection of the electron beam. In this case, as has already been described with reference to FIG. 3B, the AC voltage V2, which is induced in the intermediate electrode Gm by the AC voltage component Vd of the dynamic voltage through the capacitance C1 between the intermediate electrode Gm and fifth grid G5, capacitance C2 between the intermediate electrode Gm and sixth grid G6, and capacitance C3 between the additional electrode Gs and third grid G3 (Gi), is reduced. For example, as stated above, if $$C1=2.5pF$$

$$C1=2.5pF$$

$$C3=48.5pF,$$

the AC voltage V2 is given by $$V2=0.05Vd$$

If Vd=600 V, V2=30 V.

Figure 15:
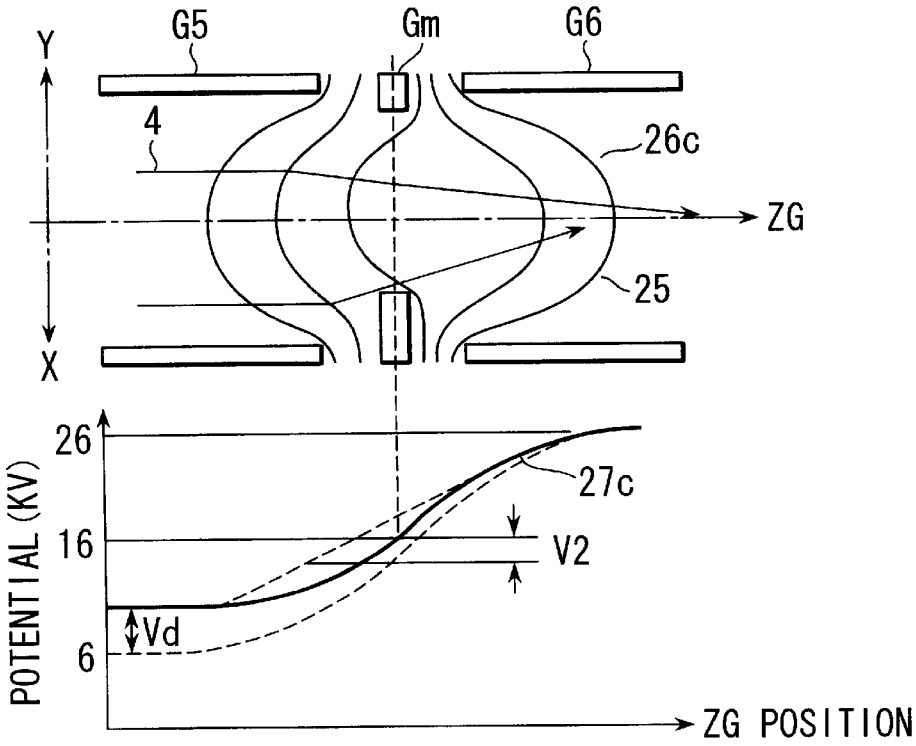
FIG. 15 is a view showing an electric field of the main lens at a time of deflection, and a view showing a potential distribution on the center axis of the electron beam passage hole.
Figure 16:
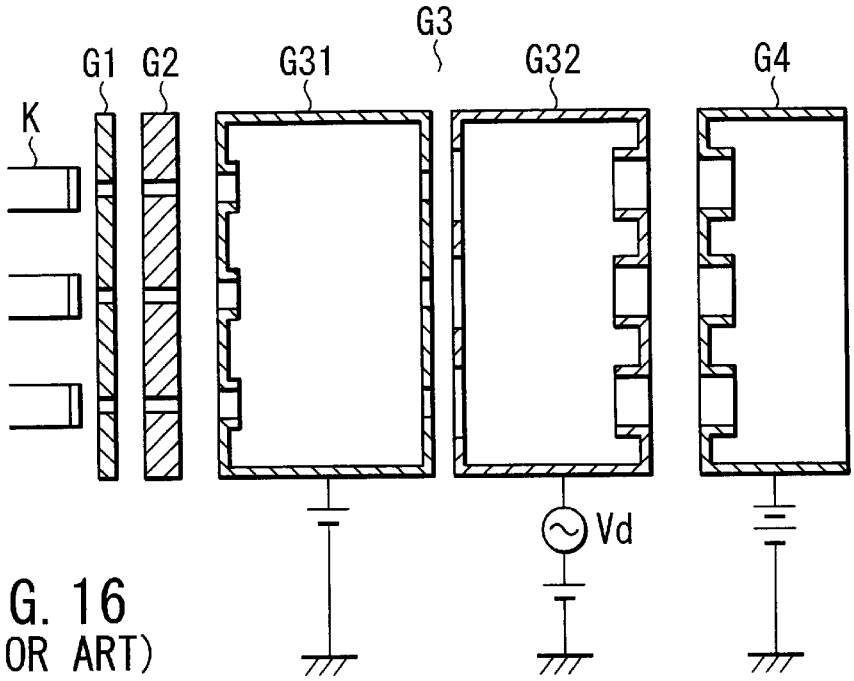
FIG. 16 (PRIOR ART)
FIG. 16 is a horizontal cross-sectional view showing the structure of a conventional electron gun structure with a BPF type DAC&F system.
Figure 17:
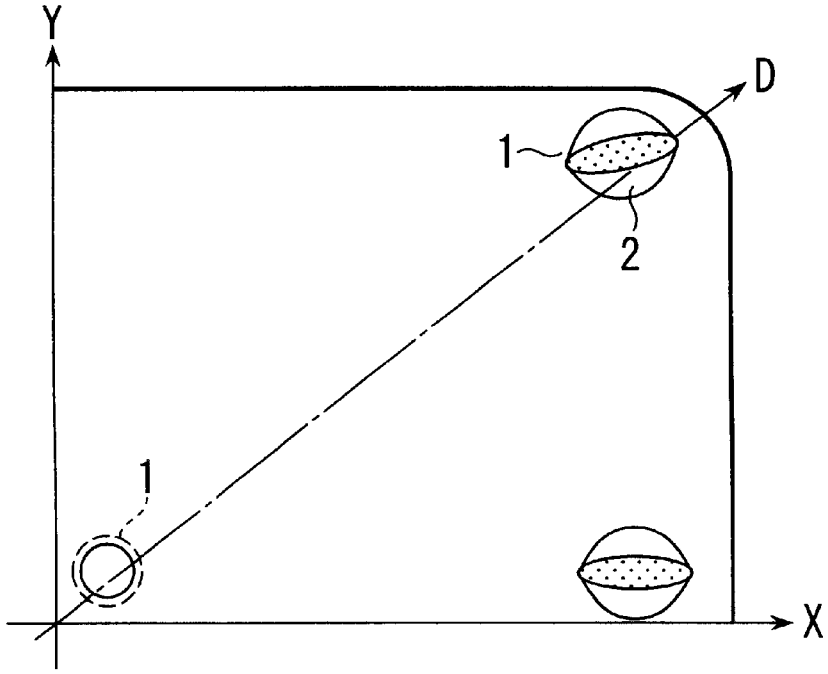
FIG. 17 (PRIOR ART)
FIG. 17 shows a beam spot shape on a phosphor screen of a conventional in-line type color CRT apparatus.
Figure 18:
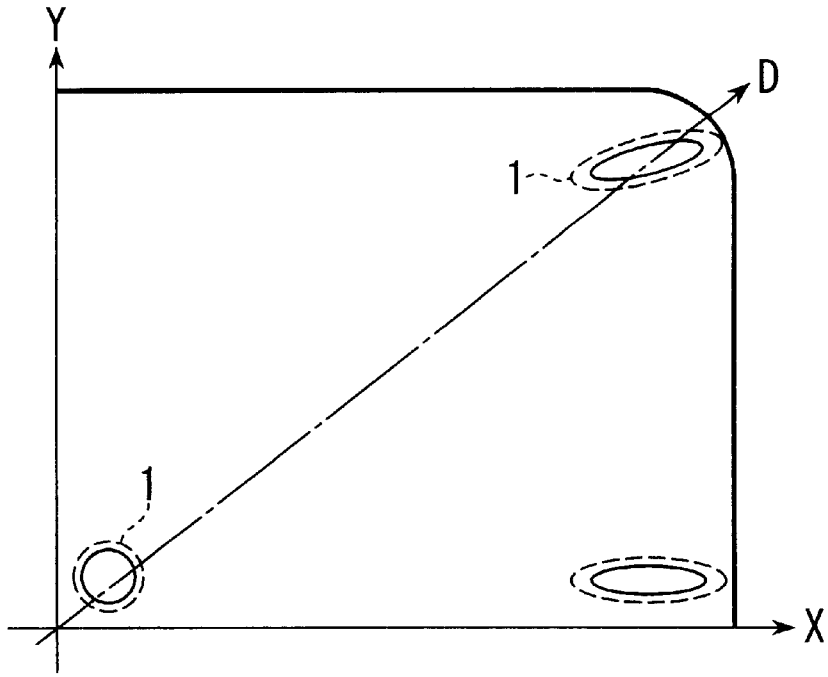
FIG. 18 (PRIOR ART)
FIG. 18 shows a beam spot shape on a phosphor screen of a color CRT apparatus having the electron gun structure with a BPF type DAC&F system as shown in FIG. 16.

In this case, the main lens is formed by an electric field 26*c* as shown in FIG. 15. This main lens produces a potential distribution 27*c* on the center axis ZG of the electron beam passage hole, as shown in FIG. 15. Specifically, since the rise in potential of the intermediate electrode Gm is suppressed, the fifth grid (G5)-side electric field intensity of the intermediate electrode Gm becomes greater than the sixth grid (G6)-side electric field intensity of the intermediate electrode Gm. Consequently, the sixth grid (G6)-side potential permeates to the fifth grid (G5) side via the non-circular electron beam passage hole with a horizontal long axis in the intermediate electrode Gm. Accordingly, the quadrupole lens having the horizontal focusing function and vertical diverging function is formed within the main lens. Thus, the main lens has astigmatism. As a result, the blur of the beam spot on the peripheral portion of the phosphor screen is eliminated. Moreover, the difference between the horizontal magnification Mh2 and vertical magnification Mv2 is reduced, and the horizontal deformation of the beam spot 1 on the peripheral portion of the screen is reduced, as shown in FIG. 2.

Figure 20A:
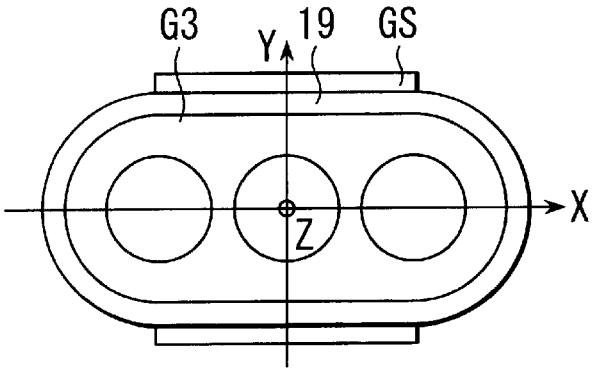
FIG. 20A and FIG. 20B show structures of another additional electrode of the electron gun structure applied to the color CRT apparatus of the present invention.
Figure 20B:
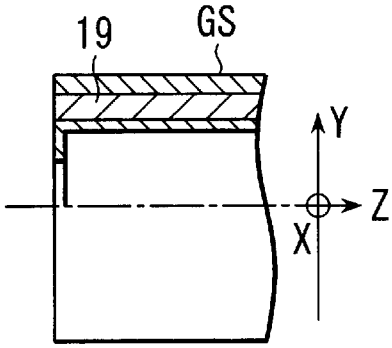

In the above-described embodiments, the additional electrode Gs has a cylindrical shape, but it may have another shape. For example, as is shown in FIG. 20, the additional electrode Gs may comprise a pair of plate-like electrodes opposed to only flat portions at vertical ends of the electrode. The plate-like electrodes are disposed to be opposed to a horizontal plane including the tube axis of the electrode. Compared to the above-described cylindrical additional electrode, this additional electrode Gs has a less capacitance C3 between itself and the electrode, but the same operational advantage as with the above-described embodiments can be obtained.

As has been described above, according to the color CRT apparatus of the present invention, the electron gun structure has at least one intermediate electrode disposed between the focus electrode and anode electrode which form the main lens for ultimately focusing the electron beam on the phosphor screen. The electron gun structure also has an additional electrode insulatively disposed on at least a part of the electrode constituting the electron lens. The additional electrode is electrically connected to the intermediate electrode. Thereby, the main lens formed in the electron gun structure incorporates a dynamically variable quadrupole lens and has astigmatism. Moreover, the AC voltage induced in the intermediate electrode via the capacitance created between the electrodes can be effectively controlled, and horizontal deformation of the beam spot over the entire screen can be reduced.

Therefore, the color CRT apparatus with a stable focusing performance can be constructed.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A color cathode-ray tube apparatus having an electron gun structure forming a plurality of electron lenses including a main lens for focusing electron beams on a phosphor screen, and a deflection yoke for horizontally and vertically deflecting the electron beams emitted from the electron gun structure, wherein the electron gun structure comprises:

a focus electrode, an ultimate acceleration electrode and at least one intermediate electrode disposed between the focus electrode and the ultimate acceleration electrode, the focus electrode, the ultimate acceleration electrode and said at least one intermediate electron forming said main lens;

a voltage application device configured to apply to the focus electrode a dynamic voltage increasing in accordance with an increase in a degree of deflection of electron beams, and to apply to the intermediate electrode a voltage obtained by dividing a voltage applied to the ultimate acceleration electrode by means of a voltage dividing resistor; and at least one additional electrode electrically insulatively covering at least a part of an outer surface of a cylindrical electrode constituting the electron lens, said at least one additional electrode being electrically connected to the intermediate electrode.

2. A color cathode-ray tube apparatus having an electron gun structure forming a plurality of electron lenses including a main lens for focusing electron beams on a phosphor screen, and a deflection yoke for horizontally and vertically deflecting the electron beams emitted from the electron gun structure, wherein the electron gun structure comprises:

a focus electrode, an ultimate acceleration electrode and at least one intermediate electrode disposed between the focus electrode and the ultimate acceleration electrode, the focus electrode, the ultimate acceleration electrode and said at least one intermediate electron forming said main lens;

a voltage application device configured to apply to the focus electrode a dynamic voltage increasing in accordance with an increase in a degree of deflection of electron beams, and to apply to the intermediate electrode a voltage obtained by dividing a voltage applied to the ultimate acceleration electrode by means of a voltage dividing resistor; and at least one additional electrode electrically insulatively covering at least a part of an outer surface of a cylindrical electrode constituting the electron lens, said at least one additional electrode Being electrically connected to the intermediate electrode;

wherein said additional electrode is disposed on the focus electrode, and said intermediate electrode is a plate-like electrode having a non-circular electron beam passage hole with a horizontal long axis.

3. A color cathode-ray tube apparatus according to claim 2, wherein said additional electrode is formed in such a cylindrical shape as to cover an outer surface of the focus electrode.

4. A color cathode-ray tube apparatus according to claim 2, wherein said additional electrode is formed in such a plate shape as to cover a flat portion on an outer surface of the focus electrode.

5. A color cathode-ray tube apparatus having an electron gun structure forming a plurality of electron lenses including a main lens for focusing electron beams on a phosphor screen, and a deflection yoke for horizontally and vertically deflecting the electron beams emitted from the electron gun structure, wherein the electron gun structure comprises:

a focus electrode, an ultimate acceleration electrode and at least one intermediate electrode disposed between the focus electrode and the ultimate acceleration electrode, the focus electrode, the ultimate acceleration electrode and said at least one intermediate electron forming said main lens;

a voltage application device configured to apply to the focus electrode a dynamic voltage increasing in accordance with an increase in a degree of deflection of electron beams, and to apply to the intermediate electrode a voltage obtained by dividing a voltage applied to the ultimate acceleration electrode by means of a voltage dividing resistor; and at least one additional electrode electrically insulatively covering at least a part of an outer surface of a cylindrical electrode constituting the electron lens, said at least one additional electrode being electrically connected to the intermediate electrode;

wherein said additional electrode is disposed on one of said electrodes other than the electrode to which the dynamic voltage is applied, and said intermediate electrode is a plate-like electrode having a non-circular electron beam passage hole with a vertical long axis.

6. A color cathode-ray tube apparatus according to claim 5, wherein said additional electrode is formed in such a cylindrical shape as to cover an outer surface of the focus electrode.

7. A color cathode-ray tube apparatus according to claim 5, wherein said additional electrode is formed in such a plate shape as to cover a flat portion on an outer surface of the focus electrode.

8. A color cathode-ray tube apparatus having an electron gun structure forming a plurality of electron lenses including a main lens for focusing electron beams on a phosphor screen, and a deflection yoke for horizontally and vertically deflecting the electron beams emitted from the electron gun structure, wherein the electron gun structure comprises:

a focus electrode, an ultimate acceleration electrode and at least one intermediate electrode disposed between the focus electrode and the ultimate acceleration electrode, the focus electrode, the ultimate acceleration electrode and said at least one intermediate electron forming said main lens;

a voltage application device configured to apply to the focus electrode a dynamic voltage increasing in accordance with an increase in a degree of deflection of electron beams, and to apply to the intermediate electrode a voltage obtained by dividing a voltage applied to the ultimate acceleration electrode by means of a voltage dividing resistor; and at least one additional electrode electrically insulatively covering at least a part of an outer surface of a cylindrical electrode constituting the electron lens, said at least one additional electrode being electrically connected to the intermediate electrode;

wherein a dielectric member is disposed between the additional electrode and the electrode covered with the additional electrode.

* * * * *